US008844311B2

(12) United States Patent
Bowen et al.

(10) Patent No.: US 8,844,311 B2
(45) Date of Patent: Sep. 30, 2014

(54) REFRIGERATOR WITH A WATER AND ICE DISPENSER HAVING AN IMPROVED ICE CHUTE AIR SEAL

(75) Inventors: Michael A. Bowen, Keystone, IA (US); Lawrence J. Ertz, Amana, IA (US); Bruce A. Kopf, Cedar Rapids, IA (US); Dean A. Martin, Solon, IA (US); Scott W. Leimkuehler, Swisher, IA (US); Chad J. Rotter, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/185,232

(22) Filed: Jul. 18, 2011

(65) Prior Publication Data

US 2011/0271706 A1 Nov. 10, 2011

Related U.S. Application Data

(63) Continuation of application No. 11/421,831, filed on Jun. 2, 2006, now Pat. No. 7,980,089, which is a continuation of application No. 11/140,096, filed on May 27, 2005, now Pat. No. 7,340,914, which is a continuation-in-part of application No. 11/028,422, filed on Jan. 3, 2005, now Pat. No. 7,418,830.

(51) Int. Cl.
*F25C 5/18* (2006.01)

(52) U.S. Cl.
USPC ..... 62/344; 62/449

(58) Field of Classification Search
CPC ..... F25C 5/005; F25C 1/08; F25C 1/10; F25C 1/147; F24D 23/126; F24D 2500/02
USPC ..... 62/344, 340, 135, 66, 137, 389, 449, 62/440; 222/146.6
See application file for complete search history.

(56) References Cited

U.S. PATENT DOCUMENTS

| | | | | |
|---|---|---|---|---|
| 2,689,669 | A | 9/1954 | Ericson | |
| 3,399,809 | A | 9/1968 | Simonich | |
| 3,537,132 | A | 11/1970 | Alvarez | |
| 3,561,231 | A | 2/1971 | Webb | |
| 3,572,053 | A * | 3/1971 | Jacobus et al. | 62/344 |
| 3,640,088 | A | 2/1972 | Jacobus et al. | |
| 3,789,620 | A | 2/1974 | Benasutti et al. | |
| 3,902,331 | A | 9/1975 | True, Jr. et al. | |
| 3,942,334 | A | 3/1976 | Pink | |

(Continued)

FOREIGN PATENT DOCUMENTS

| | | |
|---|---|---|
| CN | 1340685 A | 3/2002 |
| CN | 1412509 A | 4/2003 |

(Continued)

OTHER PUBLICATIONS

Reexam of U. S. Patent No. 7,484,382, Control No. 95/001,480: Exhibit 1—Kim 7,484,382.

(Continued)

*Primary Examiner* — Mohammad M Ali

(57) ABSTRACT

A refrigerator having an ice and water dispenser has a seal to sealingly engage the ice compartment when the refrigerator door is closed. The seal is flexible to accommodate manufacturing tolerance. The seal may be impregnated with a friction reducing agent to increase life of the seal.

15 Claims, 14 Drawing Sheets

(56) References Cited

U.S. PATENT DOCUMENTS

| | | | | |
|---|---|---|---|---|
| 4,069,545 | A | 1/1978 | Holet et al. | |
| 4,090,641 | A | 5/1978 | Lindenschmidt | |
| 4,209,999 | A | 7/1980 | Falk et al. | |
| 4,333,588 | A | 6/1982 | Schreck et al. | |
| 4,706,169 | A | 11/1987 | Bussan et al. | |
| 4,851,662 | A | 7/1989 | Ott et al. | |
| 4,872,318 | A | 10/1989 | Klemmensen | |
| 5,037,004 | A | 8/1991 | Katz et al. | |
| 5,056,688 | A | 10/1991 | Goetz et al. | |
| D324,869 | S | 3/1992 | Carper | |
| 5,211,462 | A | 5/1993 | Bien et al. | |
| 5,272,888 | A | 12/1993 | Fisher et al. | |
| 5,273,219 | A | 12/1993 | Beach, Jr. et al. | |
| 5,353,689 | A | 10/1994 | Bolt et al. | |
| 2,717,505 | A | 9/1995 | Andersson | |
| 5,473,911 | A | 12/1995 | Unger | |
| 5,474,213 | A | 12/1995 | Unger | |
| 5,526,854 | A | 6/1996 | Unger et al. | |
| D372,739 | S | 8/1996 | Bustos | |
| 5,701,235 | A | 12/1997 | Hagemeyer Cook et al. | |
| 5,768,900 | A * | 6/1998 | Lee | 62/137 |
| 5,836,669 | A | 11/1998 | Hed | |
| 5,941,619 | A | 8/1999 | Stieben et al. | |
| 5,967,371 | A | 10/1999 | Stephen | |
| 6,050,097 | A | 4/2000 | Nelson et al. | |
| 6,095,673 | A | 8/2000 | Goto et al. | |
| 6,533,003 | B1 | 3/2003 | Jacobus et al. | |
| 6,574,982 | B1 | 6/2003 | Wiseman et al. | |
| D484,150 | S | 12/2003 | Becke | |
| 6,726,341 | B2 | 4/2004 | Pashley et al. | |
| 6,735,959 | B1 | 5/2004 | Najewicz | |
| 6,789,634 | B1 | 9/2004 | Denton | |
| 6,804,974 | B1 | 10/2004 | Voglewede et al. | |
| 6,836,083 | B2 | 12/2004 | Mukai | |
| 6,895,767 | B2 * | 5/2005 | Hu | 62/135 |
| 6,964,177 | B2 | 11/2005 | Lee et al. | |
| 6,978,626 | B2 * | 12/2005 | Kim et al. | 62/74 |
| 7,065,975 | B1 | 6/2006 | Herndon et al. | |
| 7,076,967 | B2 | 7/2006 | Lee et al. | |
| 7,100,379 | B2 * | 9/2006 | Son et al. | 62/74 |
| 7,194,868 | B2 * | 3/2007 | Yoshida et al. | 62/66 |
| 7,228,703 | B2 | 6/2007 | Kim et al. | |
| D549,745 | S | 8/2007 | Coulter et al. | |
| 7,266,972 | B2 | 9/2007 | Anselmino et al. | |
| 7,284,390 | B2 | 10/2007 | Van Meter et al. | |
| 7,316,121 | B2 | 1/2008 | Lee et al. | |
| 7,591,141 | B2 | 9/2009 | Wetekamp et al. | |
| 7,870,754 | B2 | 1/2011 | Martin et al. | |
| 8,117,863 | B2 | 2/2012 | Van Meter et al. | |
| 2004/0237565 | A1 * | 12/2004 | Lee et al. | 62/344 |
| 2005/0036300 | A1 | 2/2005 | Dowling et al. | |
| 2006/0086128 | A1 | 4/2006 | Maglinger et al. | |
| 2006/0086129 | A1 | 4/2006 | Anselmino et al. | |
| 2006/0086130 | A1 | 4/2006 | Anselmino et al. | |
| 2006/0086131 | A1 | 4/2006 | Pastryk et al. | |
| 2006/0086132 | A1 | 4/2006 | Maglinger et al. | |
| 2006/0090496 | A1 | 5/2006 | Adamski et al. | |
| 2006/0201189 | A1 | 9/2006 | Adamski et al. | |
| 2006/0266055 | A1 | 11/2006 | Anderson et al. | |
| 2007/0245762 | A1 | 10/2007 | Maglinger et al. | |
| 2008/0011010 | A1 | 1/2008 | Koons et al. | |
| 2008/0016900 | A1 | 1/2008 | Bippus et al. | |
| 2008/0041090 | A1 | 2/2008 | Lee et al. | |
| 2008/0134709 | A1 | 6/2008 | Fischer et al. | |
| 2008/0168794 | A1 | 7/2008 | Cho et al. | |
| 2008/0289355 | A1 | 11/2008 | Kang et al. | |
| 2009/0038330 | A1 | 2/2009 | Lee et al. | |
| 2009/0064703 | A1 | 3/2009 | Kim et al. | |
| 2009/0064704 | A1 | 3/2009 | Wu et al. | |
| 2009/0173098 | A1 | 7/2009 | Kim et al. | |
| 2009/0255289 | A1 | 10/2009 | Friedmann et al. | |
| 2010/0037631 | A1 | 2/2010 | Choi et al. | |
| 2010/0050677 | A1 | 3/2010 | Lu et al. | |
| 2010/0050681 | A1 | 3/2010 | Ryu et al. | |
| 2010/0058796 | A1 | 3/2010 | Kim | |
| 2010/0077789 | A1 | 4/2010 | Lim et al. | |
| 2010/0199701 | A1 | 8/2010 | Yoon et al. | |
| 2010/0257887 | A1 | 10/2010 | Hwang | |
| 2010/0287970 | A1 | 11/2010 | Choi | |

FOREIGN PATENT DOCUMENTS

| | | | |
|---|---|---|---|
| EP | 1482263 | A2 | 1/2004 |
| EP | 1517103 | A2 | 3/2005 |
| EP | 1519131 | A1 | 3/2005 |
| JP | 50069644 | | 6/1975 |
| JP | 56-47453 | | 4/1981 |
| JP | 2-29589 | A | 1/1990 |
| JP | 2-103382 | A | 4/1990 |
| JP | 4-15477 | A | 1/1992 |
| JP | 4-222378 | A | 8/1992 |
| JP | 5-10660 | A | 1/1993 |
| JP | 5-66084 | A | 3/1993 |
| JP | 5-71849 | A | 3/1993 |
| JP | 5-79367 | U | 10/1993 |
| JP | 6-11228 | A | 1/1994 |
| JP | 6-147743 | A | 5/1994 |
| JP | 7-19701 | A | 1/1995 |
| JP | 7-174453 | A | 7/1995 |
| JP | 7-294115 | A | 11/1995 |
| JP | 7-301479 | A | 11/1995 |
| JP | 7-305946 | A | 11/1995 |
| JP | 8-61824 | A | 3/1996 |
| JP | 8-271110 | A | 10/1996 |
| JP | 9-145210 | A | 6/1997 |
| JP | 9-303944 | A | 11/1997 |
| JP | 11-101544 | A | 4/1999 |
| JP | 11-211308 | A | 8/1999 |
| JP | 2000-9372 | A | 1/2000 |
| JP | 2000-111229 | A | 4/2000 |
| JP | 2000-161830 | A | 6/2000 |
| JP | 2000-266458 | A | 9/2000 |
| JP | 2000-337760 | A | 12/2000 |
| JP | 2001-116410 | A | 4/2001 |
| JP | 2001-349657 | A | 12/2001 |
| JP | 2002-139271 | A | 5/2002 |
| JP | 2002-181429 | A | 6/2002 |
| JP | 2003-10896 | A | 1/2003 |
| JP | 2003-114075 | A | 4/2003 |
| JP | 2003-121043 | A | 4/2003 |
| JP | 2003121043 | A | 4/2003 |
| JP | 2003-262438 | A | 9/2003 |
| JP | 2004-53092 | A | 2/2004 |
| JP | 3545617 | B2 | 4/2004 |
| JP | 2006105418 | A2 | 4/2006 |
| JP | 51-21165 | | 11/2007 |
| JP | 4032673 | B2 | 11/2007 |
| JP | 49-77571 | B | 4/2009 |
| KR | 1988-0000896 | A | 3/1988 |
| KR | 1994-0011915 | A | 6/1994 |
| KR | 95-25387 | A | 9/1995 |
| KR | 1996-0018479 | A | 6/1996 |
| KR | 1997-0059690 | A | 8/1997 |
| KR | 1999-001784 | A | 1/1999 |
| KR | 1999-007058 | A | 1/1999 |
| KR | 1999-0156726 | B1 | 1/1999 |
| KR | 1999-0034649 | A | 5/1999 |
| KR | 1999-0182534 | B1 | 5/1999 |
| KR | 1999-0021510 | U | 6/1999 |
| KR | 1999-0031599 | U | 7/1999 |
| KR | 1999-0056269 | A | 7/1999 |
| KR | 200164305 | Y1 | 10/1999 |
| KR | 20-0256596 | Y1 | 12/2001 |
| KR | 10-0356542 | B1 | 10/2002 |
| KR | 2003-0018246 | A | 3/2003 |
| KR | 2003-0030961 | A | 4/2003 |
| KR | 2003-0092871 | A | 12/2003 |
| KR | 30-0355715 | S | 7/2004 |
| KR | 2004-00571587 | A | 7/2004 |
| KR | 2004-0102570 | A | 12/2004 |
| KR | 2005-0023863 | A | 3/2005 |
| KR | 2005-0028227 | A | 3/2005 |
| KR | 2005-0028656 | A | 3/2005 |
| KR | 2005-0028657 | A | 3/2005 |

(56) References Cited

FOREIGN PATENT DOCUMENTS

| | | | |
|---|---|---|---|
| KR | 2005-0028658 | A | 3/2005 |
| KR | 2005-0094673 | A | 9/2005 |
| KR | 2005-0117536 | A | 12/2005 |
| WO | 03102481 | A1 | 12/2003 |
| WO | 2004085937 | A1 | 10/2004 |
| WO | WO2008/135473 | A2 | 11/2008 |

OTHER PUBLICATIONS

Reexam of U. S. Patent No. 7,484,382, Control No. 95/001,480: Exhibit 2—IDS 0382.
Reexam of U. S. Patent No. 7,484,382, Control No. 95/001,480: Exhibit 3—Yasuzo JP2000-009372.
Reexam of U. S. Patent No. 7,484,382, Control No. 95/001,480: Exhibit 4—Najewicz 6,735,959.
Reexam of U. S. Patent No. 7,484,382, Control No. 95/001,480: Exhibit 5—Cur 5,375,432.
Reexam of U. S. Patent No. 7,484,382, Control No. 95/001,480: Exhibit 6—Fischer 5,272,888.
Reexam of U. S. Patent No. 7,484,382, Control No. 95/001,480: Exhibit 7—Buchser 5,077,985.
Reexam of U. S. Patent No. 7,484,382, Control No. 95/001,480: Exhibit 8—Shin KR2001-0029590.
Reexam of U. S. Patent No. 7,484,382, Control No. 95/001,480: Exhibit 9—Haag 4,226,489.
Reexam of U. S. Patent No. 7,484,382, Control No. 95/001,480: Exhibit 10—Lee 6,964,177.
Reexam of U. S. Patent No. 7,484,382, Control No. 95/001,480: Exhibit 11—Chekal 7,008,032.
Reexam of U. S. Patent No. 7,484,382, Control No. 95/001,480: POA 382.
Reexam of U. S. Patent No. 7,484,382, Control No. 95/001,480: Request Inter Partes Reexam 382.
Reexam of U. S. Patent No. 7,484,382, Control No. 95/001,480: Transmittal Reexam 382.
Reexam of U. S. Patent No. 7,490,475, Control No. 95/001,481: EfilingAck receipt for Reexam 475 HOU03 1254375 1.
Reexam of U. S. Patent No. 7,490,475, Control No. 95/001,481: Exhibit 1—475 Patent.
Reexam of U. S. Patent No. 7,490,475, Control No. 95/001,481: Exhibit 2—IDS 475 Reexam.
Reexam of U. S. Patent No. 7,490,475, Control No. 95/001,481: Exhibit 3—Cur 5,375,432.
Reexam of U. S. Patent No. 7,490,475, Control No. 95/001,481: Exhibit 4—Najewicz 6,735,959.
Reexam of U. S. Patent No. 7,490,475, Control No. 95/001,481: Exhibit 5—Yasuzo JP2000-009372.
Reexam of U. S. Patent No. 7,490,475, Control No. 95/001,481: Exhibit 6—Kwon KR2000-0073340.
Reexam of U. S. Patent No. 7,490,475, Control No. 95/001,481: Exhibit 7—Oh KR1999-021017.
Reexam of U. S. Patent No. 7,490,475, Control No. 95/001,481: Exhibit 8—Kim KR1999-0031494.
Reexam of U. S. Patent No. 7,490,475, Control No. 95/001,481: Exhibit 9—Park KR1998-0189120.
Reexam of U. S. Patent No. 7,490,475, Control No. 95/001,481: Exhibit 10—Kim KR1999-0066209.
Reexam of U. S. Patent No. 7,490,475, Control No. 95/001,481: Exhibit 11—Coates 5,813,245.
Reexam of U. S. Patent No. 7,490,475, Control No. 95/001,481: POA.
Reexam of U. S. Patent No. 7,490,475, Control No. 95/001,481: Request Reexam 475.
Reexam of U. S. Patent No. 7,490,475, Control No. 95/001,481: Transmittal 475 Reexam.
JP 2000-111229—English Translation.
JP 2003-121043—English Translation.
KR 95-25387, Samsung Electronics Co., Ltd.—English Translation.
KR 1999-001784, Samsung Electronics Co., Ltd.—English Translation.
KR 1999-0021510, Daewoo Electronics Co., Ltd.—English Translation.
KR 1999-0182534, Samsung Electronics Co., Ltd.—English Translation.
KR 10-0356542, Samsung Electronics Co., Ltd.—English Translation.
KR 2003-0018246, LG Electronics, Inc.—English Translation.
KR 2003-0030961—English Translation.
KR 2003-0092871—English Translation.
KR 2004-0102570, LG Electronics Inc.—English Translation.
Reexam of U. S. Patent No. 7,484,382, Control No. 95/001,480: EfilingAck receipt for Reexam 382 filing HOU03 1254364 1.
KR 2005-0028656, LG Electronics Inc.—English Translation.

* cited by examiner

REFRIGERATOR WITH A WATER AND ICE DISPENSER HAVING AN IMPROVED ICE CHUTE AIR SEAL

CROSS-REFERENCE TO RELATED APPLICATIONS

This application is a Continuation Application of U.S. patent application Ser. No. 11/421,831 filed Jun. 2, 2006, which is A Continuation Application of U.S. patent application Ser. No. 11/140,096 filed May 27, 2005, now U.S. Pat. No. 7,340,914, issued Mar. 11, 2008, which is a Continuation-in-Part of U.S. application Ser. No. 11/028,422 filed Jan. 3, 2005, entitled REFRIGERATOR WITH FORWARD PROJECTING DISPENSER, now U.S. Pat. No. 7,418,830 issued on Sep. 2, 2008, in which all applications are hereby incorporated by reference in their entirety.

BACKGROUND OF THE INVENTION

The present invention relates generally to refrigerators and more particularly to ice and water dispensers located on the outer surfaces of the doors of refrigerators. As is well known, a refrigerator may be provided with an ice dispenser and a water dispenser. Such dispensers typically are mounted in a front panel of a refrigerator door. In a side-by-side refrigerator, the dispenser generally is located in the freezer compartment door. Each dispenser typically has a lever, actuator button, or actuator pad disposed at the rear most surface of the housing into which a glass or cup can be inserted for filling. A glass may be pressed against the actuation button, pad, or lever, thus activating the dispensing of water or ice cubes, as desired.

Typically, the dispenser has a cavity that is inset into a door of the refrigerator. The inset cavity of the dispenser takes up valuable storage space within the inner compartment. This storage space is further compromised when an actuator and other circuitry is located at the rear side of the dispenser cavity.

Additionally, dispensers located within a door compartment have a cavity which receives only limited size beverage containers. For example, a typical water and ice dispenser can receive a beverage glass that holds 12-16 ounces of fluids but not a thermos, cooler, or large capacity beverage glass such as a 48-ounce or 64-ounce cup.

Dispensers typically have another problem with showering the user with ice chips and water spray when the dispenser is being used. This is mostly due to the fact that an ice chute and water tube are located out of sight up above the control panel for the dispenser and therefore a user cannot see exactly where to locate the container which is to be filled. Then, ice chips or water spray splatters about. Thus, it is desirable to have a dispenser which reduces splattering ice chips and water and helps the user to determine proper location of the container for dispensing.

Another problem with typical dispensers is that the ice chute door is typically opened and closed with an electrical solenoid. The solenoid is usually relatively noisy, creating an electric buzz or snap sound as the solenoid actuates, causing the dispenser door to open or close. Additionally, solenoids have a relatively high power consumption. Therefore, it is desirable to have an ice chute door which is operable with less power consumption, and less noise.

A further problem with typical dispensers is that they leak air between the ice box and the ice chute. This is mostly because of manufacturing variances in parts. This in turn causes cold air loss, and moisture/ice buildup. Therefore, it is desirable to reduce air leak between the ice chute and the ice box.

Thus, a primary objective of the present invention is the provision of an improved water and ice dispenser for a refrigerator.

Accordingly, one feature or advantage of the present invention is the provision of an ice and water dispenser that allows for increased storage capacity behind the ice and water dispenser.

Another feature or advantage of the present invention is the provision of an ice and water dispenser that accommodates large cups, water bottles, pitchers, thermoses, coolers, etc.

Another feature or advantage of the present invention is the provision of an ice and water dispenser which helps a user to locate the receiving container in the proper location and also helps to reduce splatter or spray of ice chips or water on the user.

Another feature or advantage of the present invention is the provision of an ice and water dispenser that has a lower power consumption and a quieter ice chute door.

Another feature or advantage of the current invention is reduced air leak between the ice chute and the ice box.

One or more of these or other features or advantages will become apparent from the following specification and claims.

SUMMARY OF THE INVENTION

The present invention is directed towards a refrigerator with a forward projecting ice and water dispenser attached to the front panel of a refrigerator door. In general, the door of the invention includes an outer door pan, an inner door liner, an ice chute extending through the door, and a dispenser engaging the ice chute. The refrigerator door of the present invention has an outer door cavity and an inner liner cavity.

One feature of the present invention is an ice chute that is in both the liner cavity and the outer door cavity. This positioning of the ice chute permits the dispenser to be placed forward the front panel of the door to receive ice from the ice chute.

A further feature of the present invention is a more efficient utilization of storage space upon the inner liner. The forward projecting dispenser makes unnecessary a deep dispenser cavity in both the outer door and the inner liner which necessitates a deep inner liner cavity to accommodate the dispenser protruding into the door.

A further feature of the invention is the ability to permit oversized cups, water bottles, pitchers, coolers, thermoses, etc. being filled more easily as they do not need to fit within a cavity protruding into the refrigerator door. One problem typically encountered with filling oversized containers is a drip tray interfering with the positioning of the oversized container underneath the ice and/or water dispenser. Therefore, a feature of the present invention is a retractable drip pan adjacent the front panel of the refrigerator door or removable from the front panel. Additionally, the drip tray may be independent the dispenser and attached by a magnet or other attachment means which may be moved when oversize containers are being filled.

A further feature of the invention is a dispenser with a retracting ledge moveable between a first position and a second position which can be used for holding or supporting containers in shallow dispensers. The retracting ledge can then be moved out of the way when not needed.

A further feature of the present invention is a dispenser with an angled back side. Having an angled back side, allows more storage space inside the refrigerator compartment along the door.

A further feature of the present invention is a lighted dispenser target ring extending at least partially around the water tube and the ice chute. The lighted dispenser target ring allows a user a target area for locating the receiving container during dispensing and additionally helps to block oversprayed water or ice chips.

A further feature of the present invention is an ice and water dispenser with an ice chute door openable with an electric motor. The electric motor rotates a cam which in turn flips open the ice chute door. This allows for quieter opening of the ice chute door and less power consumption during opening of the ice chute door over standard solenoid operated ice chute doors.

A further feature of the invention is an ice chute air seal between the ice chute and the ice box. This reduces cold air loss from the ice box and therefore reduces moisture/ice buildup.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF THE PREFERRED EMBODIMENT

The present invention will be described as it applies to its preferred embodiment. It is not intended that the present invention be limited to the preferred embodiment. It is intended that the invention cover all modifications and alternatives that may be included within the spirit and scope of the invention.

Figure 1:
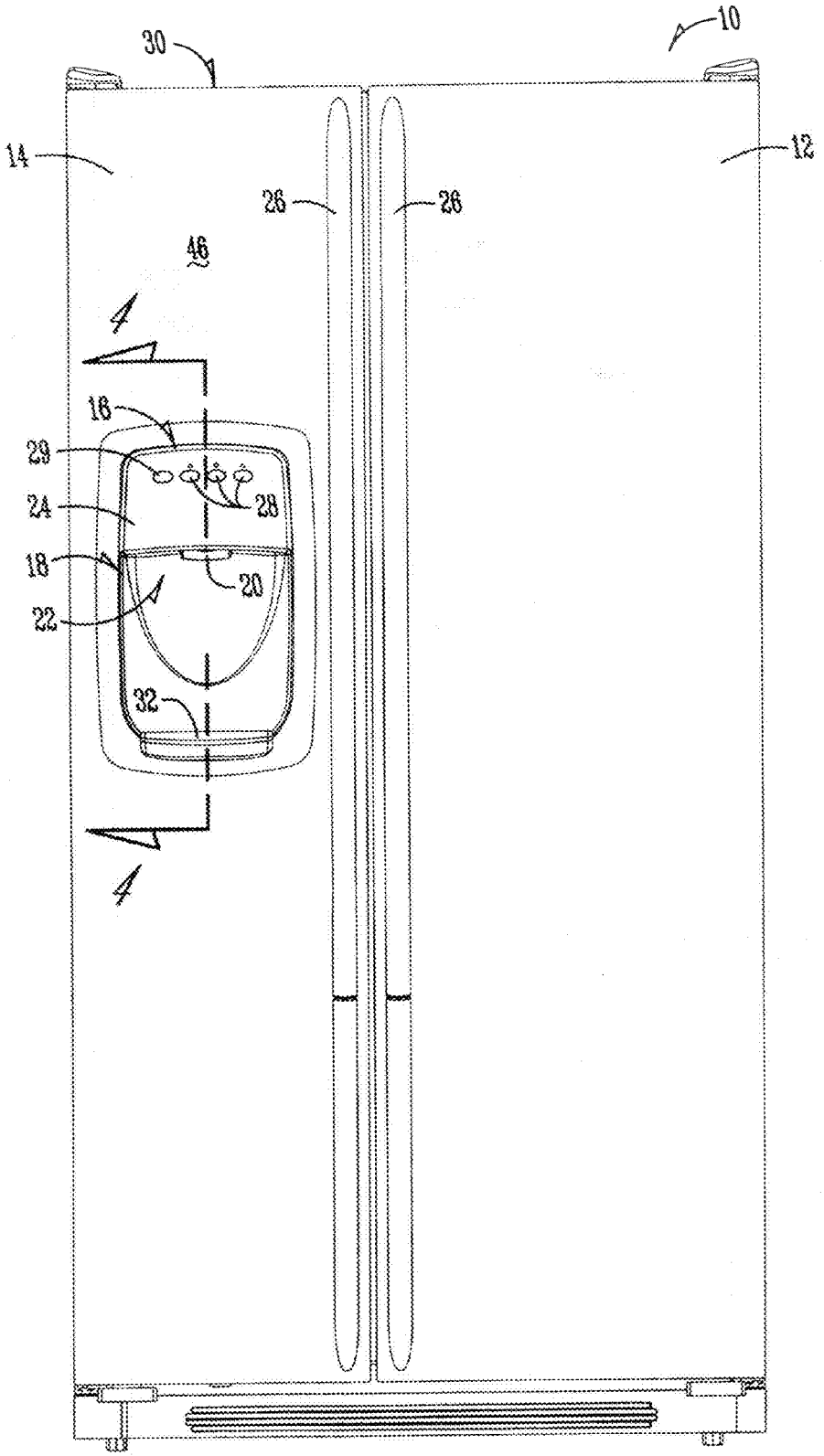
FIG. 1 is a front elevation view of a refrigerator having a forward projecting dispenser with a drip pan included with the dispenser housing.

With reference to FIG. 1, a conventional refrigerator 10 is shown, refrigerator 10 being of the side-by-side design, wherein refrigerator 10 has a refrigeration compartment sealed by a refrigerator door 12 and a freezer compartment sealed by a freezer door 14. One of the doors 12, 14 may be provided with a dispenser 16, generally including a housing 18 defining a dispensing area 22 for an ice chute 20 and water tube 34.

Dispenser 16 may utilize ice and/or water selection buttons 28 and an actuator 29. The user may select water and/or the type of ice to be dispensed such as ice cubes or crushed ice using buttons 28. The user selects and dispenses ice and water by pressing actuator button 29 that actuates delivery of ice through the ice chute 20 and/or water through the water tube 34.

It should be noted that the dispenser 16 could also be found in other types of refrigerators, other than those of side-by-side construction, and thus the dispenser of the present invention, as will hereinafter be described in greater detail, can similarly be used in both refrigerators of side-by-side design, as well as other designs.

Figure 2:
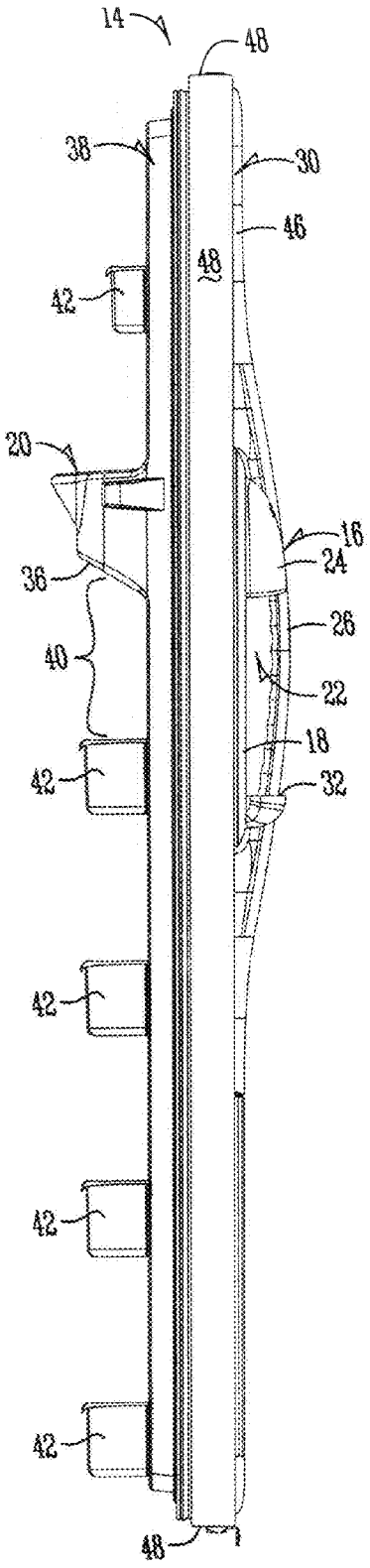
FIG. 2 is a side elevation view of the freezer door of FIG. 1.
Figure 8:
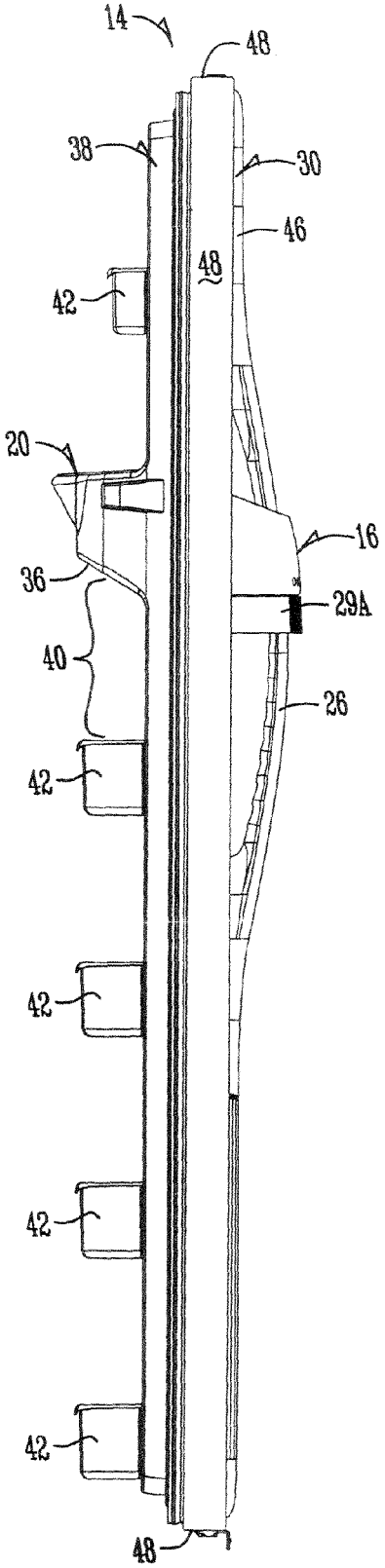
FIG. 8 is a side view of the door of FIG. 7.

The refrigerator 10 has handles 26 extending outward. The dispenser 16 extends outward from the door 14. As shown in FIG. 2 the dispenser may extend approximately level with the handles 26. Alternatively, the dispenser may extend beyond the handle especially when no dispensing cavity 22 is provided for and as illustrated in FIG. 8.

FIG. 2 illustrates the side of the ice and water dispenser 16. Dispenser housing 18 frames the control panel 24, the dispensing area 22, and a catch tray or drip pan 32. The control panel 24 and drip pan 32 extend forward the front panel 46 of the outer door panel.

Figure 3:
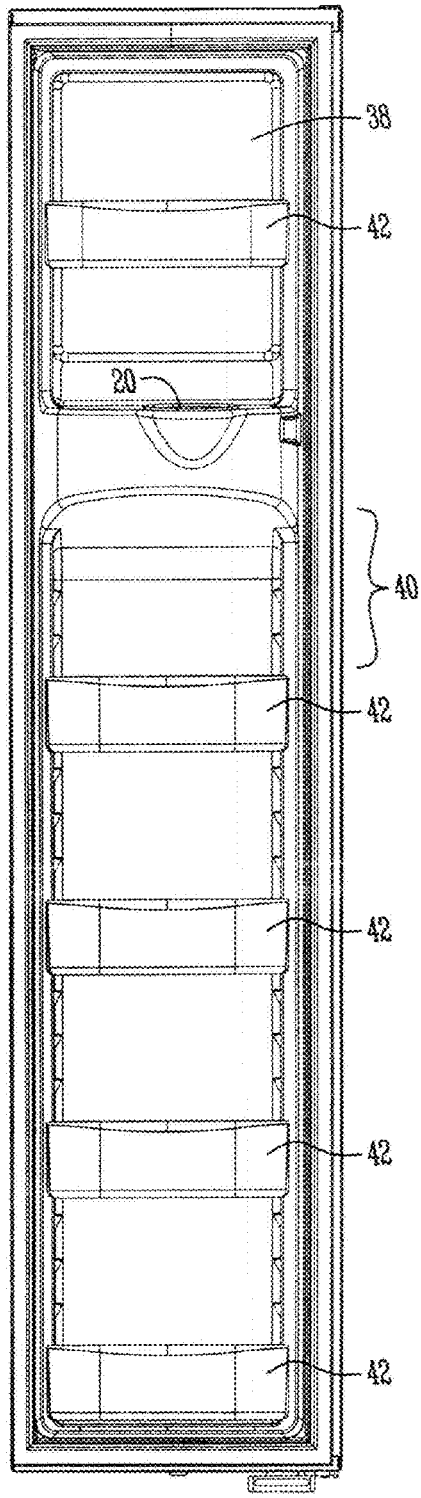
FIG. 3 is a rear elevation view of a door using a forward projecting dispenser.
Figure 10:
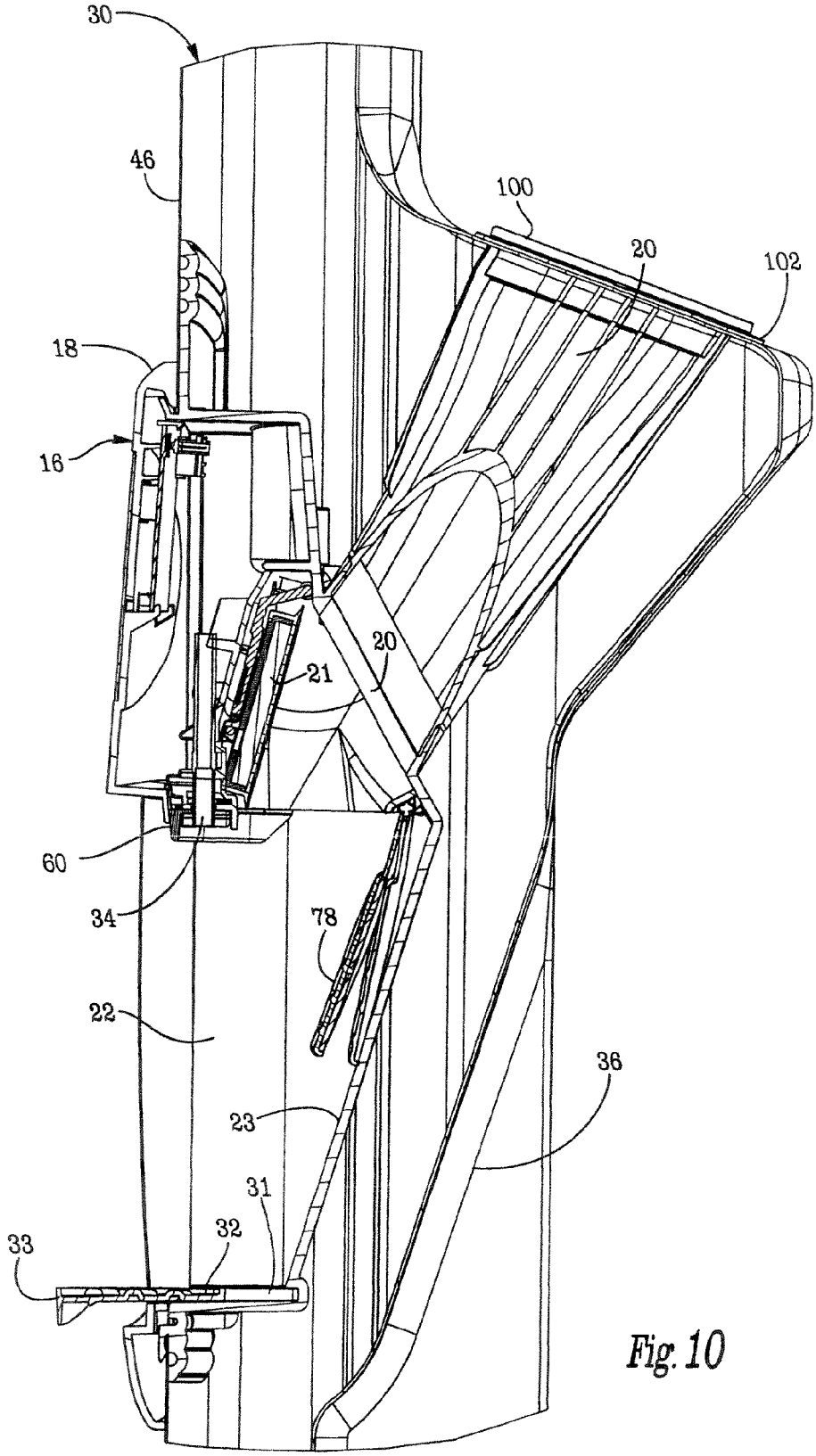
FIG. 10 is a sectional side view of another embodiment of a dispenser in a refrigerator door.
Figure 11:
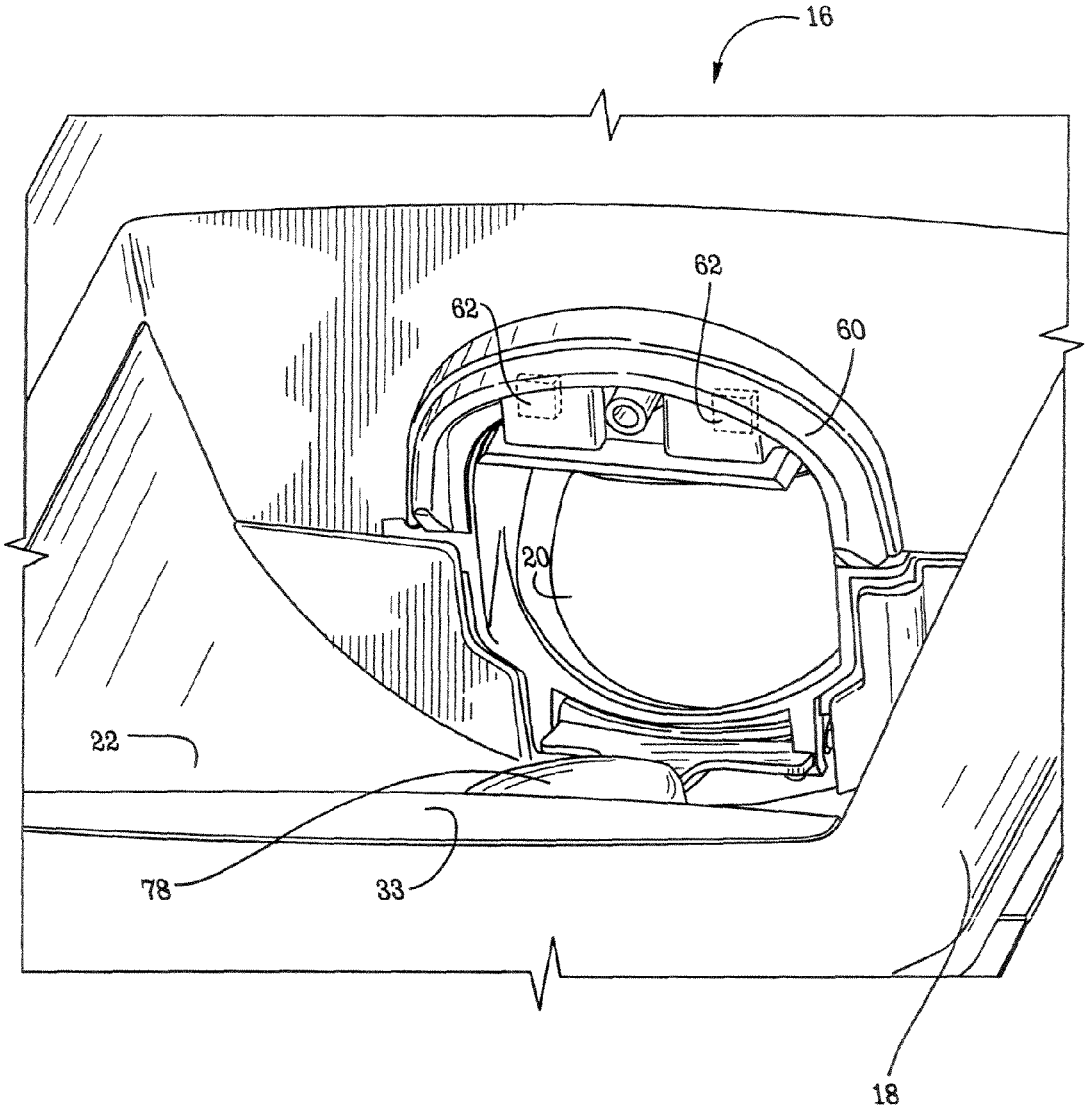
FIG. 11 is a perspective view looking upwardly from a front side of a dispenser up into the dispensing cavity and the ice chute.
Figure 12:
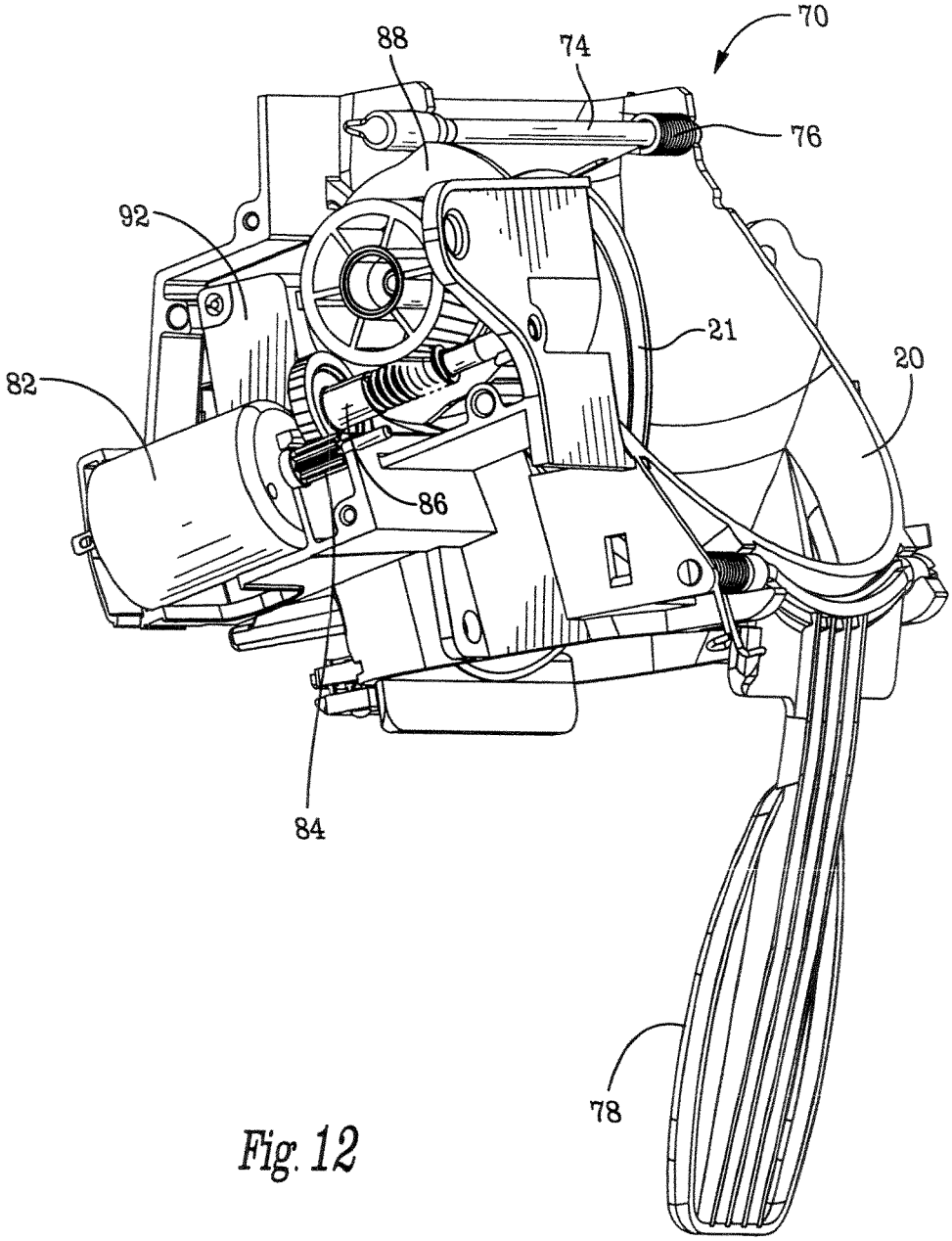
FIG. 12 is one embodiment of an ice chute actuator assembly.

As seen in FIG. 2 and FIG. 3, the forward projecting dispenser 16 permits the ice chute 20 to be the only structure within an inner liner cavity 44. In contrast, the prior art as seen in FIGS. 10-12 require an inner liner cavity 44A to not only accommodate an ice chute but also the dispenser cavity. Accordingly, the forward projecting dispenser permits a space 40 to be available for a shelf 42. This extra space 40 is an 11-inch to 12-inch area below the ice chute 20.

In general, the doors, 12, 14 include an outer door pan 30 and an inner liner 38. The outer door pan 30 is formed of sheet metal and includes a front panel portion 46. The door pan 30 can also be constructed of plastic or a combination of metal and plastic. The sheet metal is bent so as to form a top, bottom and opposing side wall portions 48. Typically, the piece of sheet metal is further bent to define a plurality of flange portions (not shown). The inner door liner 38 is thermal formed but could also be injection molded. In any event, inner door liner 38 includes a portion which defines the inner liner cavity. The inner liner 38 attaches to the outer door pan 30 typically at the plurality of flange portions. Insulation foam is then filled into the void defined by the outer door cavity 50 and the inner liner cavity 44.

Figure 4:
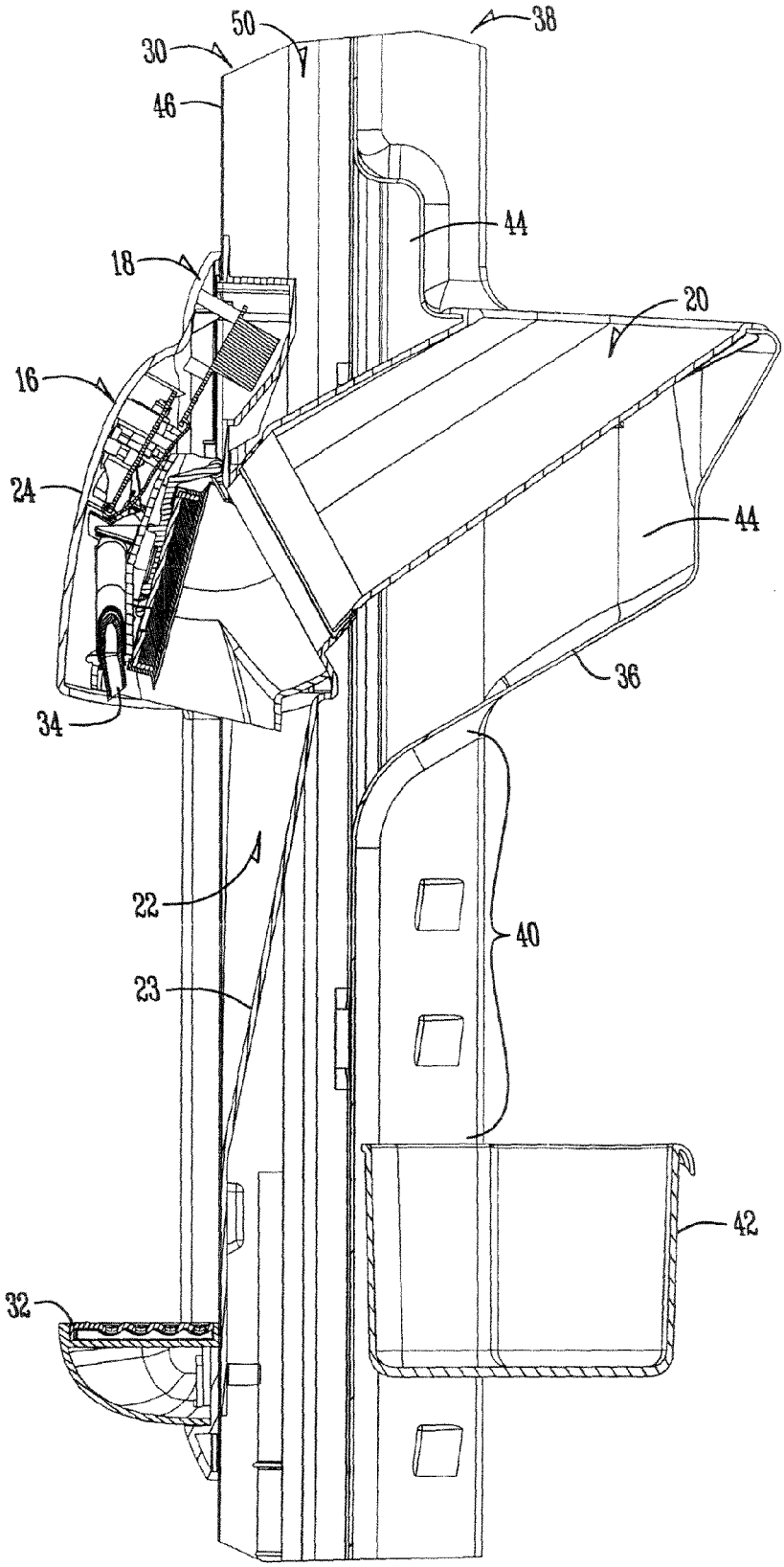
FIG. 4 is a cross sectional view taken along line 4-4 of FIG. 1.

As seen in FIG. 4, the ice chute 20 extends through both the liner cavity 44 and the outer door cavity 50. Storage space is maximized by having the liner cavity 44 partially defined by an angled side 36 that follows the diagonally mounted ice chute 20. This is different than the prior art as seen in FIG. 12 which only has the ice chute 20 extending through the liner cavity 44.

Figure 5:
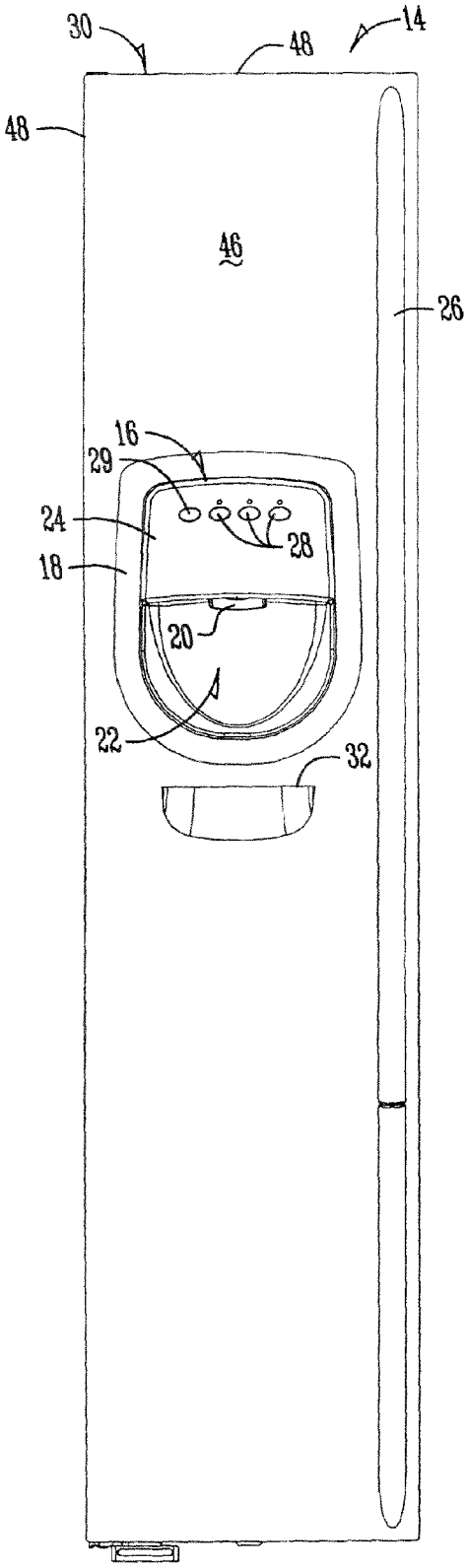
FIG. 5 is a front view of a door with a forward projecting dispenser of the present invention with a drip pan independent and removable from the dispenser housing.
Figure 6:
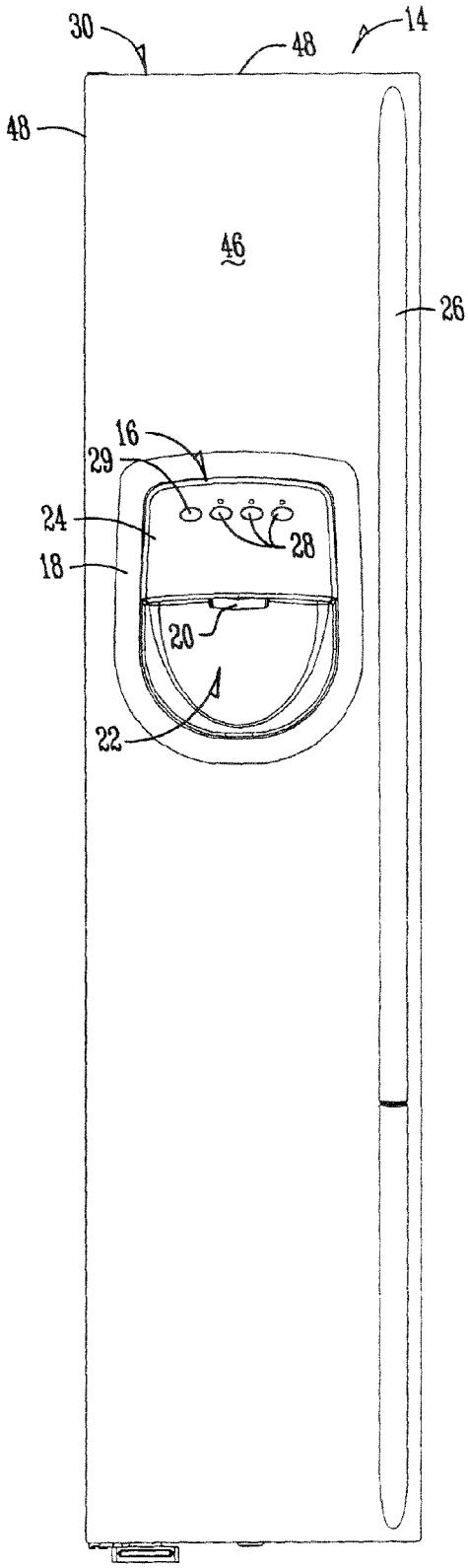
FIG. 6 is a front view of the door of FIG. 5 with the drip pan removed.
Figure 9:
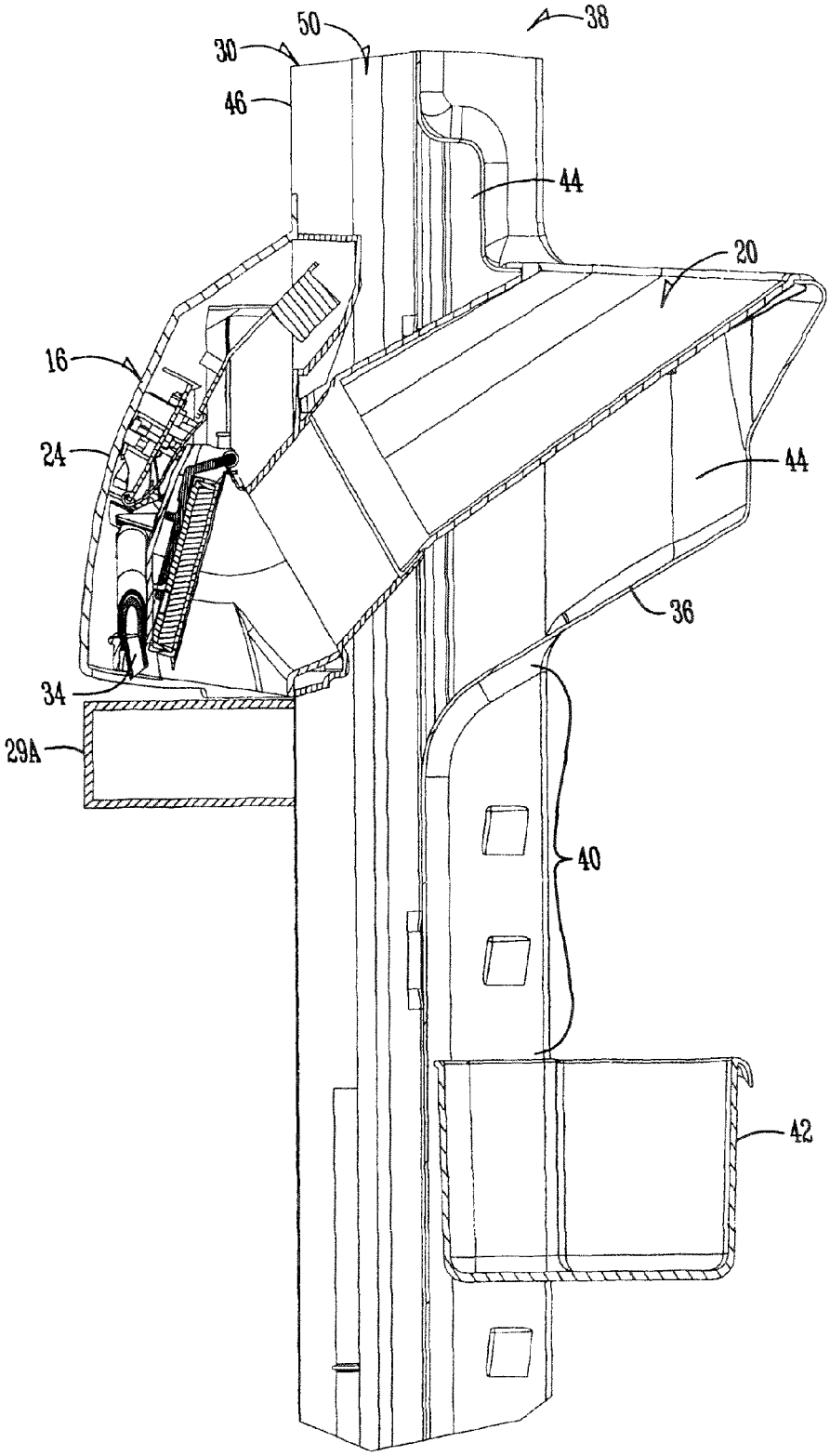
FIG. 9 is a cross sectional view taken along line 9-9 of FIG. 7.

As further seen in FIG. 4, the forward projecting dispenser 16 permits a less deep ice dispenser cavity 22. As seen in FIGS. 4, 9, and 10 the dispenser cavity 22 may have an angled back side or sloped dispensing cavity 23 protruding into the outer door cavity portion of the outer door pan 30. A drip pan 32 may be placed on the front panel 46 by an attachment such as screws or may be magnetically attached so that it may be removed as seen in FIGS. 5 and 6. The drip pan 32 may be removed whenever larger containers or oversized containers are desired to be filled.

FIG. 10 shows an embodiment of an ice and water dispenser 16 with an angled backside or sloped dispensing cavity 23. The sloped dispensing cavity 23 is preferably projected no more than one inch from the door pan 30. While other depth of projections are also within the scope of the invention, deeper projections reduce storage space inside the refrigerator door. The back slope of the cavity 23 is angled upward and inward with respect to an inside of the refrigerator to minimize the space required by the dispensing cavity 22. This configuration maximizes space available inside of the fresh food or freezer compartment. Thus, the shallow dispensing cavity 23 allows for extra space 40 and therefore an extra shelf or storage bin 42 in the door.

Figure 7:
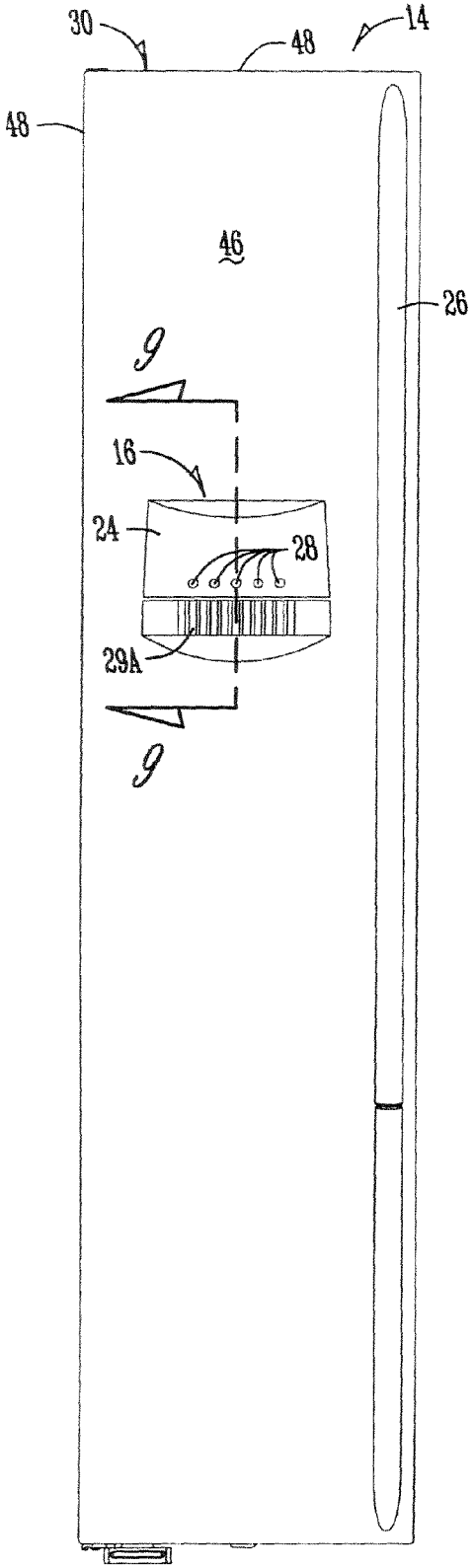
FIG. 7 is a front view of a door with a forward projecting dispenser without a dispenser cavity.

As seen in FIGS. 7-9, an alternate embodiment of the forward projecting dispenser 16 does not utilize a dispensing cavity 22. The dispenser 16 extends forward from the front panel 46 a distance beyond the handle 26 to accommodate large and oversized containers. Additionally, a depressible actuator 29A is provided that is pushed inwardly to actuate the dispensing of ice and/or water. The actuator 29A doubles as a drip pan 32 and catches excess water when it is released for return back into place under the water tube 34. The actuator 29A is removable for cleaning.

Figure 15:
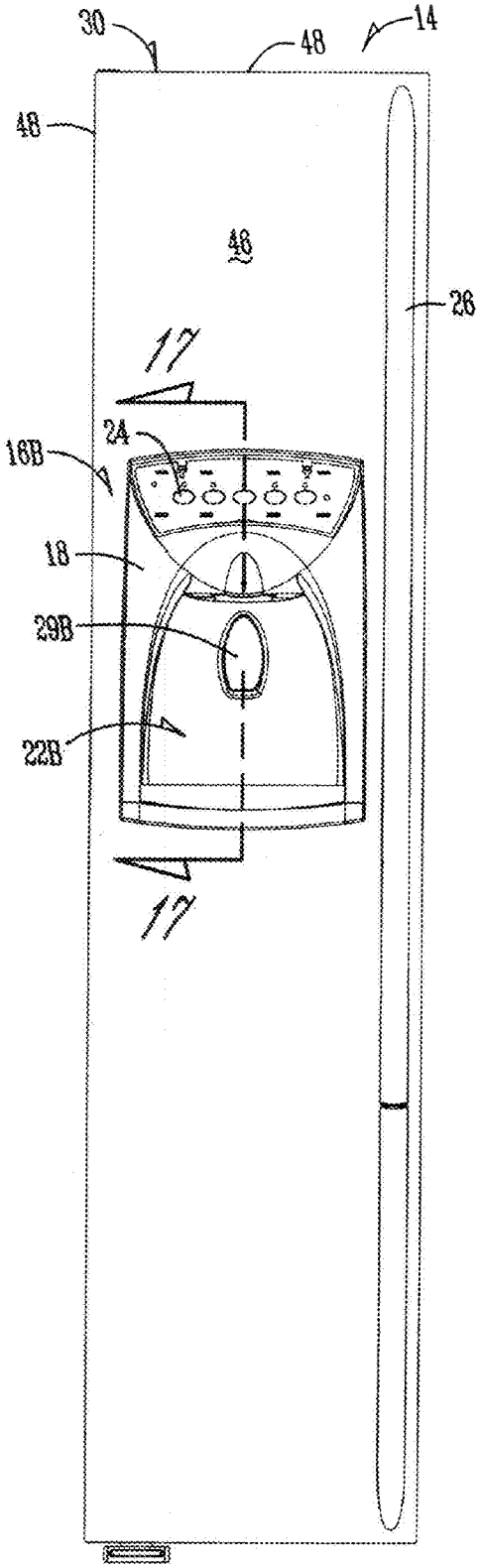
Fig.15 (Prior Art)
FIG. 15 is a front view of a prior art ice and water dispenser.
Figure 16:
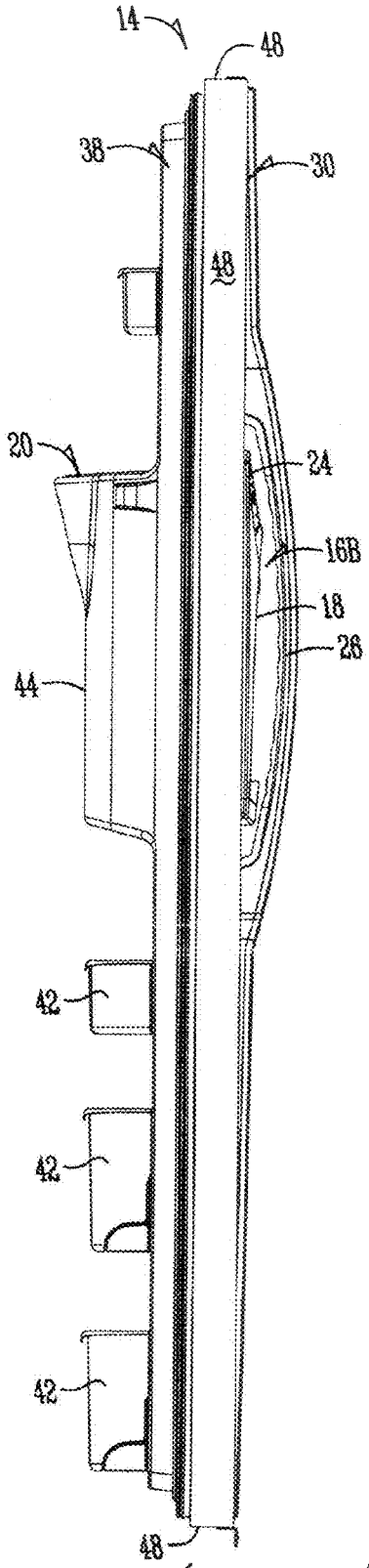
Fig.16 (Prior Art)
FIG. 16 is a side view of the prior art ice and water dispenser of FIG. 15.
Figure 17:
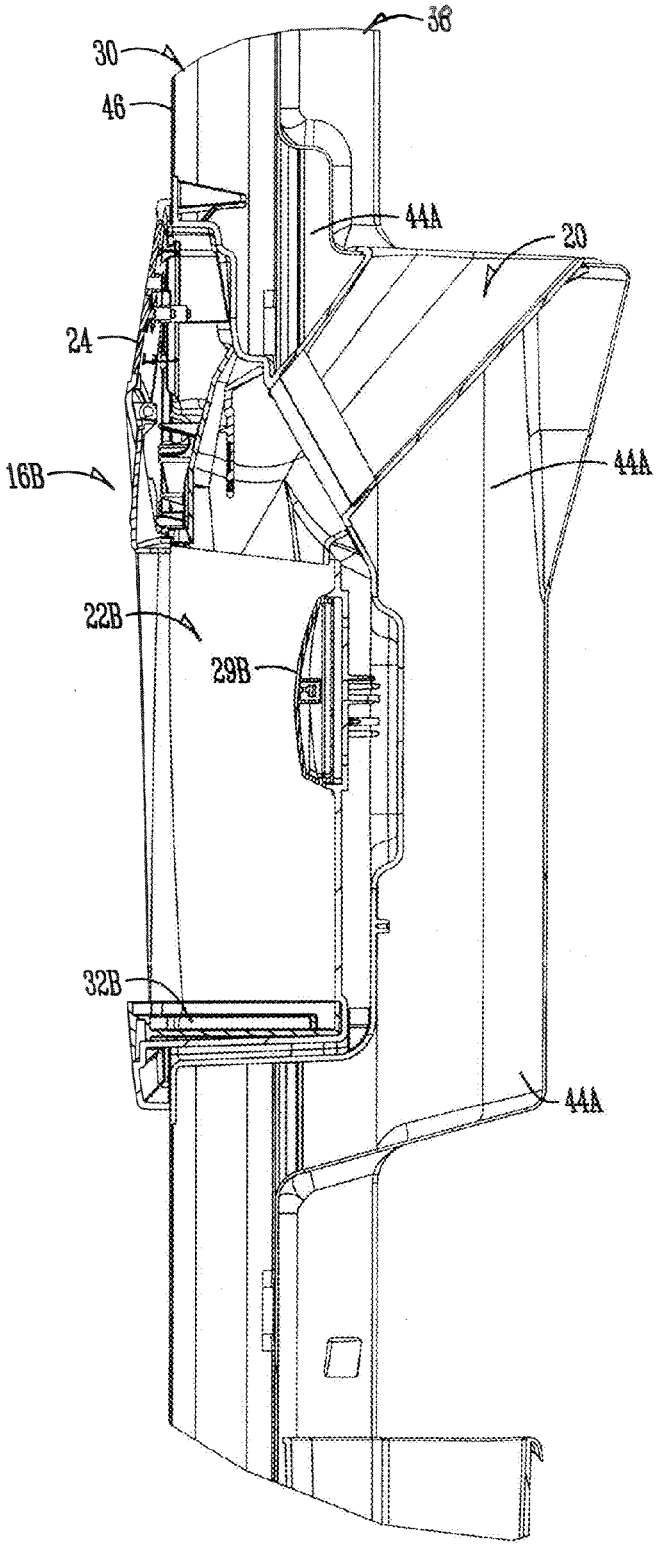
Fig. 17 (Prior Art)
FIG. 17 is a cross sectional view taken along line 17-17 of FIG. 15.

The prior art, as seen in FIGS. 15-17, only shows the ice chute 20 in the inner liner 38 portion and specifically a liner cavity 44. The liner cavity is elongated to insulate the dispenser cavity 22B. The actuator 29B and related circuitry is at the rear of the cavity 22B. Also the drip pan 32B is within the cavity 22B. As seen most clearly in FIG. 16, the dispenser 16B is approximately flush with front panel 46 as opposed to forward projecting.

The dispenser 16 includes a retractable ledge 33, as best seen in FIG. 10. The ledge 33 is movable between an extended position shown in FIG. 10 wherein the front edge is positioned outwardly from the front surface of the door 12 and a retracted position in FIG. 11 wherein the front edge is flush with the front surface of the door 12. The ledge 33 is configured as a tray drip pan 32 but does not have to be. The retracting ledge 33 can be temporarily extended from the shallow main dispenser area 22 to accommodate setting a glass, a pitcher, or other container during ice or water dispensing.

The retracting ledge 33 can be designed to pull out, fold up, fold down, or even be removable. As seen in FIG. 10, the retracting ledge 33 slides in a groove 31. It is preferred that the retracting ledge 33 have a stop (not shown) which prevents the retracting ledge 33 from being easily removed from the dispensing cavity 22. The groove 31 additionally helps support the retracting ledge 33 when the ledge 33 is supporting a glass, pitcher, or other container during dispensing. The ledge 33 is most useful in dispensers having a shallow dispensing area 22, however, the ledge 33 can also be used in a dispenser 16 having a deeper dispensing area 22.

As best seen in FIGS. 10 and 11, the dispenser 16 has a lighted dispenser target 60. The lighted dispenser target 60 is preferably a light pipe which gathers light from the cavity light, such as light emitting diodes 62, to provide a lighted ring, or similar device, as a target for a glass in the dispenser cavity 22. A portion of the light provided to the cavity 22 is captured by a portion of the lighted dispenser target 60 which directs the light around the opening for ice and water into the cavity 22. The lighted dispenser target 60 also helps to contain ice chips and spray from the user of the dispenser 16. Since the lighted dispenser target 60 is capturing light from the dispenser light source 62, it is preferred to be of a transparent or at least translucent material. The shape of the lighted target dispenser 60 is shown as a rounded arc. This shape works best for containing water spray and ice chips, however, any shape can be used. As best seen in FIG. 11, the lighted dispenser extends downwardly around or in front of target 60 and the water tube 34 and ice chute 20 so as to protect a user from water or ice spray.

Prior art dispensers have used lighted actuator arms which provide a target for placement of a glass during use of the dispenser 16. However, a lighted actuator arm does nothing to help reduce water spray or ice chip splatter.

Figure 13:
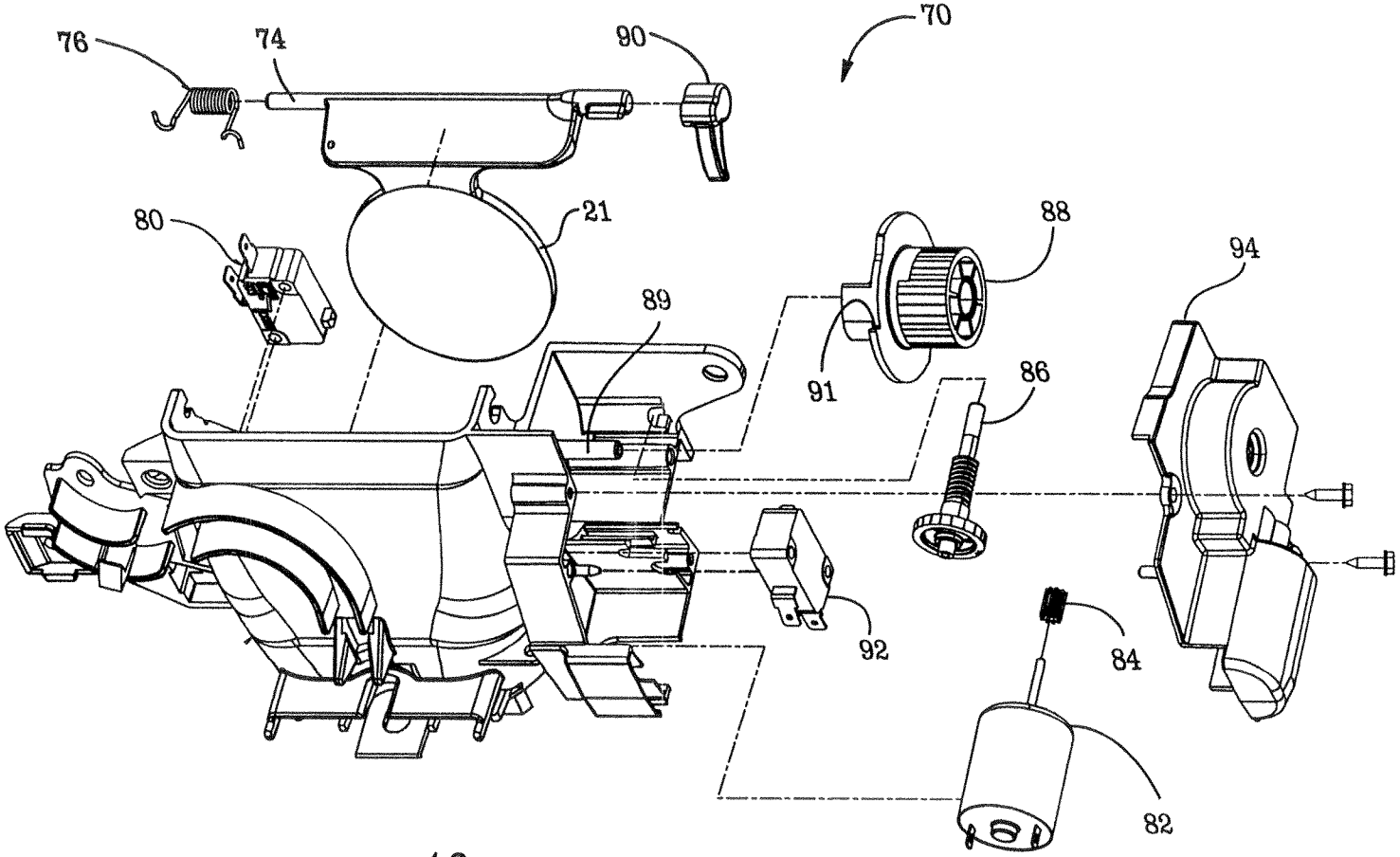
FIG. 13 is an exploded view of the actuator assembly of FIG. 12.

As best seen in FIGS. 12 and 13, the dispenser 16 has a motorized ice chute door assembly 70. FIG. 12 is a perspective view from the back and side of the assembly 70. FIG. 13 is an exploded view from the top/front/side of the assembly 70. A low current draw motor 82 is used to move the ice chute door 21. The ice chute door 21 substantially closes off the ice chute 20 when not dispensing ice so as to reduce cold air loss from the ice making or storage compartment. The motor 82 opens the ice chute door 21 using a cam 88. A position switch 92 is provided to register the ice chute door 21 position as "open" or "closed". An ice chute door hinge 74 and spring 76 biases the ice chute door 21 to a closed position with respect to the ice chute 20. The motorized ice chute door assembly 70 replaces the commonly used solenoid-opened-ice chute door.

In the preferred operation, the user operates the motorized ice chute door assembly 70 by pressing a glass, pitcher, or other similar container against an actuator 78 or other switch type device. The actuator 78 is shown to be an arm in FIG. 10, but may alternately be a pad, button, or other mechanism. The actuator 78 can activate an ice or water dispenser, along with the opening of the ice chute door 21.

In one embodiment, the actuator 78 applies pressure against an actuator switch 80. This requires little force from a user and thus is capable of allowing soft type containers, such as a Styrofoam cup, to be used with the dispenser 16. The actuator switch 80 closes an electrical circuit which powers the motor 82. The motor 82 rotates a motor gear 84 attached to the shaft of the motor 82. The motor gear 84, in turn, rotates a worm gear 86.

The worm gear 86 mates with gears on a cam 88. The cam 88 thus rotates about a cam shaft 89 and is followed by a cam follower 90. The cam follower 90 follows the peaks and valleys on the cam 80 and is operatively connected to the ice chute door 21. The ice chute door 21 pivots along the hinge 74 with the cam follower 90 to open the ice chute 20. Other configurations or gear trains can be used so long as a motor drives them.

It is preferred that the cam 88 be constructed so that as the cam follower 90 follows the peaks and valleys on the cam 88 so that the ice chute door 21 will open and close with the peaks and valleys of the cam 88. It is further preferred, but not necessary, that the cam 88 be constructed with a cam notch 91 such that the cam follower 90 locks into place so as to hold the ice chute door 21 open until the container is disengaged from the actuator arm 78, afterwhich the ice chute door 21 automatically closes. It is preferred that the motorized ice chute door assembly 70 be constructed to enclose the motor 82 with a motor housing cover 94.

As the ice chute door 21 opens, it comes in contact with the position switch 92, which instructs the motor 82 to stop turning when the door reaches the proper location. A delay is provided in the control system of the refrigerator 10 using an intelligent controller, which then permits the motor 82 to release force upon the motor shaft, which in turn, permits the ice chute door spring 76 to close the ice chute door 21.

The motorized chute extension door assembly 70 has advantages over a standard solenoid which is used in many dispensers. Some of the benefits include reduced size, better control, permitting a spring biased chute door 21, lower power consumption, reduced electrical noise, and no door snap sound upon opening as with a solenoid. However, the primary benefit of a motorized ice chute door assembly 70 is reduced power consumption over a standard solenoid opened door at approximately 2 watts versus 20 watts.

The motorized ice chute door assembly 70 contemplated by this invention, can use any number of gears and/or cams so long as a motor is used for opening the ice chute door 21.

Figure 14:
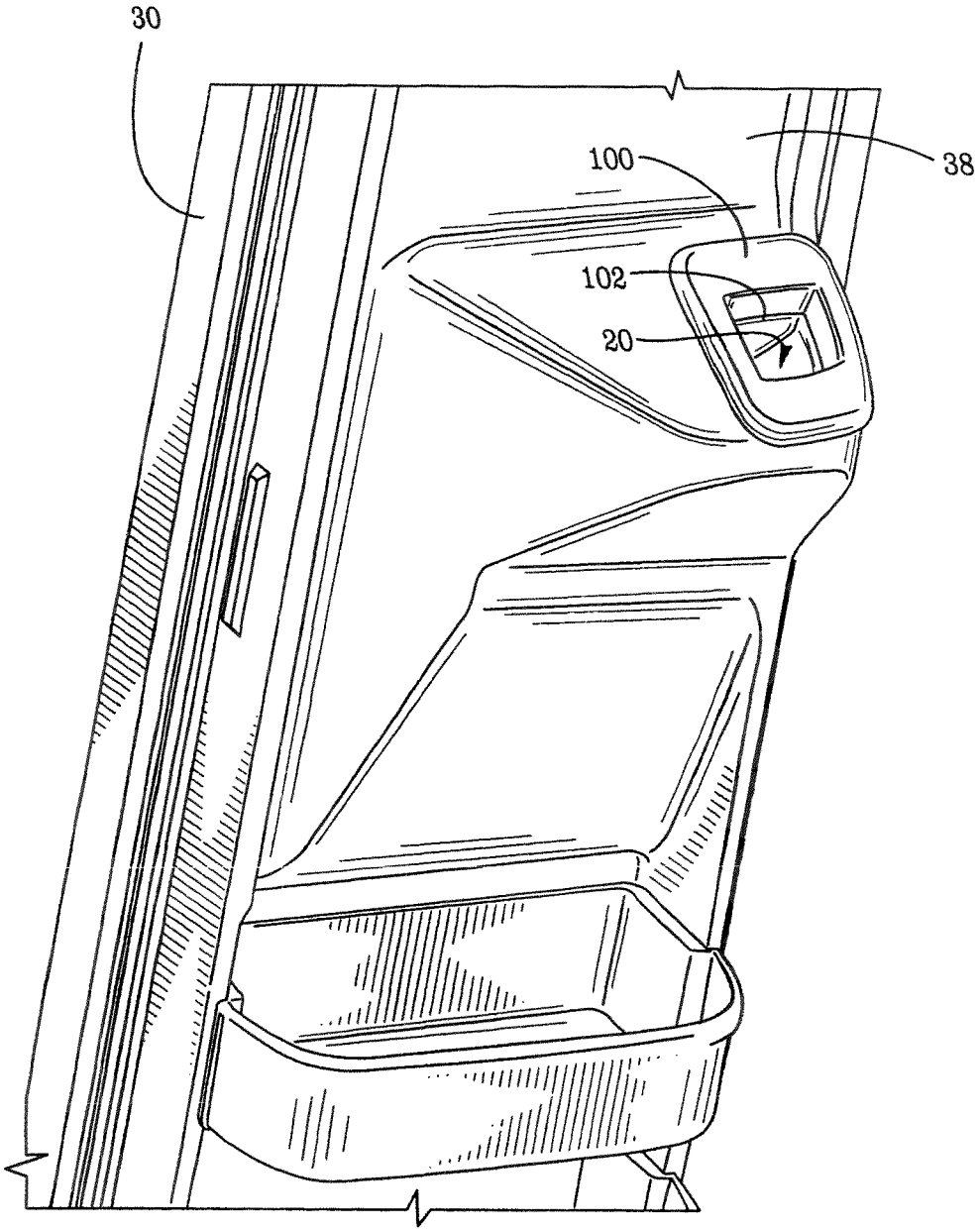
FIG. 14 is a perspective view of an inside of a refrigerator door showing an ice chute air seal.
Figure 14A:
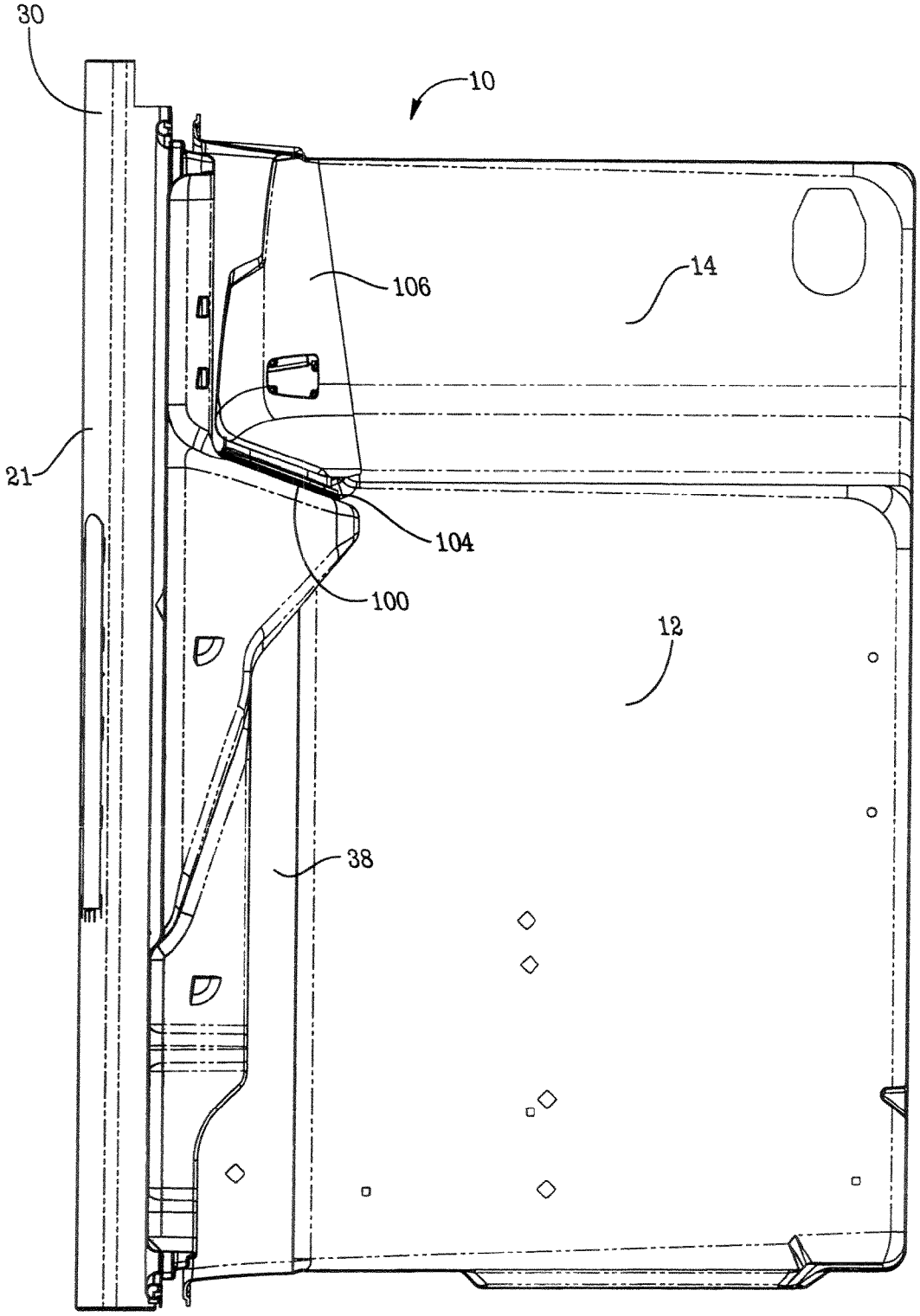
FIG. 14A is a side view of a refrigerator showing the ice chute air seal.

The dispenser 16 of the current invention has an ice chute air seal 100, as seen in FIGS. 14 and 14A. The seal 100 is preferred to be made of a flexible material compound including components such as PVC (polyvinyl chloride), TPV (thermoplastic vulcanizate), MPR (melt-processable rubber), TPU (thermoplastic urethane) or TPE (thermoplastic elastomer). Seal 100 can be made of any material providing compression and expansion properties in a form suitable for molding to a mating surface or extrusion in the alternate method of construction. The flexible material compound of which seal 100 is comprised may include additive such as Kemamide (stearyl erucamide) or PTFE (polytetraflouroethylene) to reduce the coefficient of friction and therefore improve wear resistance at the interface 100 of the seal and ice-box cover 106, or at the interface of the seal 100 and door liner 38 in an alternate method of construction.

In the present invention, the seal 100 is comprised of a flexible material over-molded upon a rigid plate (not shown) having a wand type cross-section and attached to the inner door liner 38. The seal 100 may also be comprised of a flexible, extruded wand or multi-cavitied bellows profile and attached by means of a relatively rigid plate (not shown), or by other means to the inner door liner 38. Alternatively, the seal 100 may be attached to the ice compartment 106 cover. In the preferred embodiment of the invention, the seal 100 is preferred to be attached to the door liner 38 by means of the rigid plate snapping to the top portion of the ice chute 102 with a friction fit. However, the seal 100 may also be attached directly to the inner door liner 38.

The height of the seal 100 is sufficient to reduce the sensitivity of the overall design, with regard to the occurrence of an air leak at the breakable junction 104 between the dispenser 16 and an ice compartment 106 located inside the refrigerator 10, due to manufacturing variation.

In another embodiment of the seal 100, springs (not shown) can supply a resistance force around pegs (not shown) which support a plate (not shown) inserted into the door liner 38. The pegs allow for the swiping motion incurred during opening and closing of the refrigerator door 12, without displacing the seal 100. The seal 100 can comprise multiple parts, or can be a single part that stays in place with a friction fit.

The purpose of the seal 100 is to seal against air leakage at the breakable junction 104. The door 21 can be opened and closed to gain access to the fresh food compartment 12 or freezer compartment 14 inside the refrigerator 10. The ice compartment temperature is normally lower than the fresh food compartment temperature and at a higher pressure. The seal 100, located around a top portion of the ice chute 102, creates a seal between the ice compartment 106 and the ice chute 20 in order to prevent air from escaping the ice compartment and causing temperature fluctuations, moisture and/or frost buildup. The ice chute air seal 100 can be of any shape or size and is preferred to be replaceable. However, the seal 100 should seal the air gap between the ice chute 20 and the ice compartment 106.

Based on the above, it should be readily recognized that the forward projecting dispenser 16 provides an arrangement for dispensing ice and water that enables the door 12 to include additional internal storage space, create the potential for filling oversized containers, reduce power consumption during ice dispensing, and reduce air leakage between the ice chute and the ice compartment more readily than the prior art. Although described with respect to the preferred embodiment of the invention, it should be readily apparent that various changes and/or modifications can be made to the invention without departing from the spirit thereof. In general, the invention is only intended to be limited by the scope of the following claims.

What is claimed is:

1. A refrigerator comprising:
a cabinet;
a door attached to the cabinet, the door having a front panel and an inner liner; the inner liner disposed in the door;
an opening through the liner for receiving ice from an ice storage area;
an ice chute in the door in operable connection with the opening for transporting ice received
through the opening to an ice receiving area;
an ice dispenser attached to the door and engaging the ice chute, and terminating in an outlet for
discharging ice into a container positioned in the ice receiving area beneath the outlet; and
a food storage area on the inner liner directly behind the ice receiving area.

2. The refrigerator of claim 1, further comprising a seal between the ice storage area and the ice chute.

3. The refrigerator of claim 2, wherein the seal is affixed to the liner and is in a wiping relation to the storage area wall surface.

4. The refrigerator of claim 3, wherein the seal is impregnated with a lubricant.

5. The refrigerator of claim 1, wherein the ice receiving area includes an upwardly and rearwardly sloped back wall beneath the outlet to define a recess for receiving the container.

6. The refrigerator of claim 5 further comprising a water dispenser with an outlet in the ice dispenser and a drip tray attached to the door beneath the water outlet.

7. The refrigerator of claim 6 wherein the drip tray is removable.

8. The refrigerator of claim 7 wherein the drip tray is retractable.

9. A refrigerator comprising:
a cabinet;
a door attached to the cabinet;
an ice compartment within the cabinet containing an ice maker for making ice;
an ice dispenser including an ice chute through the door, the ice chute in communication to
selectively receive ice from the ice compartment at an upper portion of the ice chute, the ice chute terminating at a lower portion of the ice chute above an ice receiving area outside the door;
a compressible seal to seal between the upper portion of the ice chute and the ice compartment to
impede air from escaping the ice compartment when the door is in a closed position; and a food storage area on an inner liner directly behind the ice receiving area; the inner liner is disposed in the door.

10. The refrigerator of claim 9, wherein the door has the inner liner comprises a liner surface surrounding the upper portion of the chute that faces generally upwardly and towards the ice compartment, and wherein the ice compartment has an outer wall with a wall surface that faces generally downwardly and towards the liner surface, and wherein the liner surface and the wall surface have complementary slopes.

11. The refrigerator of claim 9, wherein the seal is affixed to the liner and is in a wiping relation to the ice compartment wall surface.

12. The refrigerator of claim 11, wherein the seal is impregnated with a lubricant to reduce wear caused by wiping of the seal during opening and closing of the door.

13. A refrigerator comprising:

a cabinet;

a door attached to the cabinet for movement between an open position to allow access to a refrigerated compartment in the cabinet and a closed position to close the refrigerated compartment, the door including a door liner; an ice compartment within the refrigerated compartment for making and storing ice; an ice maker in the ice compartment; a storage bin in the ice compartment that stores ice made by the ice maker;

the ice compartment having a cover with a sloped surface through which a downwardly disposed opening is provided, the sloped surface facing generally downwardly and towards the door;

an ice outlet chute in the door having an upper portion in communication with the ice storage bin through the ice compartment opening and a lower portion in communication with a dispensing area external to the door to dispense ice from the storage bin to the dispensing area when the door is closed, wherein the upper portion of the ice outlet chute has an inclined surface on the door liner that faces generally upwardly and towards the ice compartment at a complementary slope to the sloped surface of the ice compartment;

and a compressible seal between the inclined surface on the door liner and the sloped surface of the ice compartment to cover seal the ice outlet chute and the ice compartment from air in the refrigerated compartment when the door is in the closed position; and a food storage area on the door liner directly behind the dispensing area; the inner liner is disposed in the door.

14. The refrigerator of claim 13, wherein the compressible seal is affixed to the door and is in a wiping relation to the sloped surface of the ice compartment as the door is opened and closed.

15. The refrigerator of claim 14, wherein the seal is impregnated with a lubricant to reduce wear due to wiping of the seal during opening and closing of the door.

* * * * *